US008561425B2

(12) United States Patent
Mitra et al.

(10) Patent No.: US 8,561,425 B2
(45) Date of Patent: Oct. 22, 2013

(54) REFRIGERANT VAPOR COMPRESSION SYSTEM WITH DUAL ECONOMIZER CIRCUITS

(75) Inventors: Biswajit Mitra, Charlotte, NC (US); Yu H. Chen, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 1018 days.

(21) Appl. No.: 12/596,563

(22) PCT Filed: Apr. 24, 2007

(86) PCT No.: PCT/US2007/010067
§ 371 (c)(1),
(2), (4) Date: Oct. 19, 2009

(87) PCT Pub. No.: WO2008/130359
PCT Pub. Date: Oct. 30, 2008

(65) Prior Publication Data

US 2011/0314863 A1 Dec. 29, 2011

(51) Int. Cl.
*F25B 1/00* (2006.01)

(52) U.S. Cl.
USPC ..... 62/498; 62/115; 62/434

(58) Field of Classification Search
USPC ..... 62/434, 115, 222, 96, 498, 500, 509; 165/80.4, 104.14
See application file for complete search history.

(56) References Cited

U.S. PATENT DOCUMENTS 4,707,996 A 11/1987 Vobach
4,918,942 A * 4/1990 Jaster ..... 62/335
4,966,010 A * 10/1990 Jaster et al. ..... 62/179
5,056,329 A 10/1991 Wilkinson
5,134,859 A 8/1992 Jaster
5,174,123 A 12/1992 Erickson
5,611,211 A * 3/1997 Whipple, III ..... 62/149
6,058,729 A 5/2000 Lifson et al.
6,385,980 B1 5/2002 Sienel
6,438,978 B1 8/2002 Bessler
6,679,074 B2 1/2004 Hanson
6,694,750 B1 2/2004 Lifson et al.
7,096,679 B2 8/2006 Manole
7,114,349 B2 10/2006 Lifson et al.

(Continued)

FOREIGN PATENT DOCUMENTS

JP 52149656 12/1977

OTHER PUBLICATIONS

International Search Report and Written Opinion mailed Dec. 20, 2007 (11 pgs.).

(Continued)

*Primary Examiner* — Melvin Jones
(74) *Attorney, Agent, or Firm* — Cantor Colburn LLP

(57) ABSTRACT

A refrigerant vapor compression system includes a flash tank economizer and a refrigerant-to-refrigerant heat exchanger economizer disposed in series refrigerant flow relationship in the refrigerant circuit intermediate a refrigerant heat rejection heat exchanger and a refrigerant heat absorption heat exchanger. A primary expansion valve disposed in the refrigerant circuit in operative association with and upstream of the refrigerant heat absorption heat exchanger and an economizer expansion valve disposed in the refrigerant circuit in operative association and upstream of the flash tank economizer provide a two-step expansion process for expanding refrigerant passing through the refrigerant circuit from the refrigerant heat rejection heat exchanger to the refrigerant heat absorption heat exchanger.

27 Claims, 5 Drawing Sheets

(56) References Cited

U.S. PATENT DOCUMENTS

| | | | |
|---|---|---|---|
| 2004/0129015 | A1 | 7/2004 | Apparao et al. |
| 2005/0132729 | A1 | 6/2005 | Manole |
| 2006/0037354 | A1 | 2/2006 | Cho et al. |
| 2006/0225445 | A1 | 10/2006 | Lifson et al. |
| 2007/0012072 | A1 | 1/2007 | Qualls et al. |

OTHER PUBLICATIONS

International Preliminary Report on Patentability mailed Nov. 5, 2009 (8 pgs.).

* cited by examiner

REFRIGERANT VAPOR COMPRESSION SYSTEM WITH DUAL ECONOMIZER CIRCUITS

FIELD OF THE INVENTION

This invention relates generally to refrigerant vapor compression systems and, more particularly, to simultaneous efficiency and capacity improvement in a refrigerant vapor compression system operating in either a subcritical cycle or in a transcritical cycle.

BACKGROUND OF THE INVENTION

Refrigerant vapor compression systems are well known in the art and commonly used for conditioning air to be supplied to a climate controlled comfort zone within a residence, office building, hospital, school, restaurant or other facility. Refrigerant vapor compression systems are also commonly used in refrigerating air supplied to display cases, merchandisers, freezer cabinets, cold rooms or other perishable/frozen product storage area in commercial establishments.

Refrigerant vapor compression systems are also commonly used in transport refrigeration systems for refrigerating air supplied to a temperature controlled cargo space of a truck, trailer, container or the like for transporting perishable/frozen items by truck, rail, ship or intermodally. Refrigerant vapor compression systems used in connection with transport refrigeration systems are generally subject to more stringent operating conditions due to the wide range of operating load conditions and the wide range of outdoor ambient conditions over which the refrigerant vapor compression system must operate to maintain product within the cargo space at a desired temperature. The desired temperature at which the cargo needs to be controlled can also vary over a wide range depending on the nature of cargo to be preserved. The refrigerant vapor compression system must not only have sufficient capacity to rapidly pull down the temperature of product loaded into the cargo space at ambient temperature, but also operate efficiently at low load when maintaining a stable product temperature during transport. Additionally, transport refrigerant vapor compression systems are subject to vibration and movements not experienced by stationary refrigerant vapor compression systems.

Traditionally, most of these refrigerant vapor compression systems operate at subcritical refrigerant pressures and typically include a compressor, a condenser, and an evaporator, and expansion device, commonly an expansion valve, disposed upstream, with respect to refrigerant flow, of the evaporator and downstream of the condenser. These basic refrigerant system components are interconnected by refrigerant lines in a closed refrigerant circuit, arranged in accord with known refrigerant vapor compression cycles, and operated in the subcritical pressure range for the particular refrigerant in use. Refrigerant vapor compression systems operating in the subcritical range are commonly charged with fluorocarbon refrigerants such as, but not limited to, hydrochlorofluorocarbons (HCFCs), such as R22, and more commonly hydrofluorocarbons (HFCs), such as R134a, R410A, R404A and R407C.

In today's market, greater interest is being shown in "natural" refrigerants, such as carbon dioxide, for use in air conditioning and transport refrigeration systems instead of HFC refrigerants. However, because carbon dioxide has a low critical temperature, most refrigerant vapor compression systems charged with carbon dioxide as the refrigerant are designed for operation in the transcritical pressure regime. In refrigerant vapor compression systems operating in a subcritical cycle, both the condenser and the evaporator heat exchangers operate at refrigerant temperatures and pressures below the refrigerant's critical point. However, in refrigerant vapor compression systems operating in a transcritical cycle, the heat rejection heat exchanger, which is a gas cooler rather than a condenser, operates at a refrigerant temperature and pressure in excess of the refrigerant's critical point, while the evaporator operates at a refrigerant temperature and pressure in the subcritical range. Thus, for a refrigerant vapor compression system operating in a transcritical cycle, the difference between the refrigerant pressure within the gas cooler and refrigerant pressure within the evaporator is characteristically substantially greater than the difference between the refrigerant pressure within the condenser and the refrigerant pressure within the evaporator for a refrigerant vapor compression system operating in a subcritical cycle.

It is also common practice to incorporate an economizer into the refrigerant circuit for increasing the capacity of the refrigerant vapor compression system. For example, in some systems, a refrigerant-to-refrigerant heat exchanger is incorporated into the refrigerant circuit as an economizer. A first portion of the refrigerant leaving the condenser passes through a first pass of the heat exchanger in heat exchange with a second portion of the refrigerant passing through the second pass of the heat exchanger. The second portion of the refrigerant typically constitutes a portion of the refrigerant leaving the condenser that is diverted through an expansion device wherein this portion of the refrigerant is expanded to a lower pressure and a lower temperature vapor or vapor/liquid mixture refrigerant before this second portion of refrigerant is passed through the second pass of the economizer refrigerant-to-refrigerant heat exchanger. Having traversed the second pass of the economizer heat exchanger, the second portion of the refrigerant is thence directed into an intermediate pressure change of the compression process. The refrigerant in the primary refrigerant circuit passes through the first pass of the refrigerant-to-refrigerant economizer heat exchanger and is thus further cooled before it traverses the system's main expansion device prior to entering the evaporator. U.S. Pat. No. 6,058,729 discloses a subcritical refrigerant vapor compression system for a transport refrigeration unit incorporating a refrigerant-to-refrigerant heat exchanger into the refrigerant circuit as an economizer.

In some systems, a flash tank economizer is incorporated into the refrigerant circuit between the condenser and the evaporator. In such case, the refrigerant leaving the condenser is expanded through an expansion device, such as a thermostatic expansion valve or an electronic expansion valve, prior to entering the flash tank wherein the expanded refrigerant separates into a liquid refrigerant component and a vapor refrigerant component. The vapor component of the refrigerant is thence directed from the flash tank into an intermediate pressure stage of the compression process. The liquid component of the refrigerant is directed from the flash tank through the system's main expansion valve prior to entering the evaporator. U.S. Pat. No. 5,174,123 discloses a subcritical vapor compression system incorporating a flash tank economizer in the refrigerant circuit between the condenser and the evaporator.

In conventional subcritical refrigerant vapor compression systems, the expansion of the refrigerant passing from the condenser to the evaporator is typically a single step process wherein the refrigerant passing from the condenser to the evaporator through a single expansion device, commonly either a thermostatic expansion valve or an electronic expansion valve or a fixed orifice device, before the refrigerant enters the evaporator. U.S. Pat. No. 6,694,750 discloses a subcritical refrigeration system that includes a first refrigerant-to-refrigerant heat exchanger economizer and a second refrigerant-to-refrigerant heat exchanger economizer disposed in series in the refrigerant circuit between the condenser and the evaporator. Refrigerant passing through the primary refrigerant circuit from the condenser to the evaporator passes in series through the first pass of the first refrigerant-to-refrigerant heat exchanger and thence through the first pass of the second refrigerant-to-refrigerant heat exchanger before traversing the primary refrigerant circuit's single evaporator expansion valve prior to entering the evaporator. A second portion of the refrigerant passing from the condenser is diverted from the primary refrigerant circuit and passed through an auxiliary expansion valve and thence through the second pass of the first refrigerant-to-refrigerant heat exchanger prior to being injected into a high pressure stage of the compression process. A third portion of the refrigerant passing from the condenser is diverted from the primary refrigerant circuit and passed through another auxiliary expansion valve and thence through the second pass of the second refrigerant-to-refrigerant heat exchanger prior to being injected into a low pressure stage of the compression process.

U.S. Pat. No. 6,385,980 discloses a transcritical refrigerant vapor compression system incorporating a flash tank economizer in the refrigerant circuit between the gas cooler and the evaporator. However, in a transcritical refrigerant vapor compression system, expanding the refrigerant from the supercritical pressure at which the gas cooler operates to the subcritical pressure at which the evaporator operates in a single step expansion process may result in lower system efficiency and over-heating of the compressor due to the large pressure differential between the gas cooler pressure and the evaporator pressure.

SUMMARY OF THE INVENTION

A refrigerant vapor compression system includes a refrigerant-to-refrigerant heat exchanger economizer and a flash tank economizer disposed in the refrigerant circuit in series refrigerant flow relationship intermediate a refrigerant heat rejection heat exchanger and a refrigerant heat absorption heat exchanger. A primary expansion valve disposed in the refrigerant circuit in operative association with and upstream of the refrigerant heat absorption heat exchanger and a secondary expansion valve disposed in the refrigerant circuit in operative association and upstream of the flash tank economizer provide a two-step expansion process for expanding refrigerant passing through the refrigerant circuit from the refrigerant heat rejection heat exchanger to the refrigerant heat absorption heat exchanger.

BRIEF DESCRIPTION OF THE DRAWINGS

For a further understanding of the invention, reference will be made to the following detailed description of the invention which is to be read in connection with the accompanying drawing, where.

DETAILED DESCRIPTION OF THE INVENTION

Figure 1:
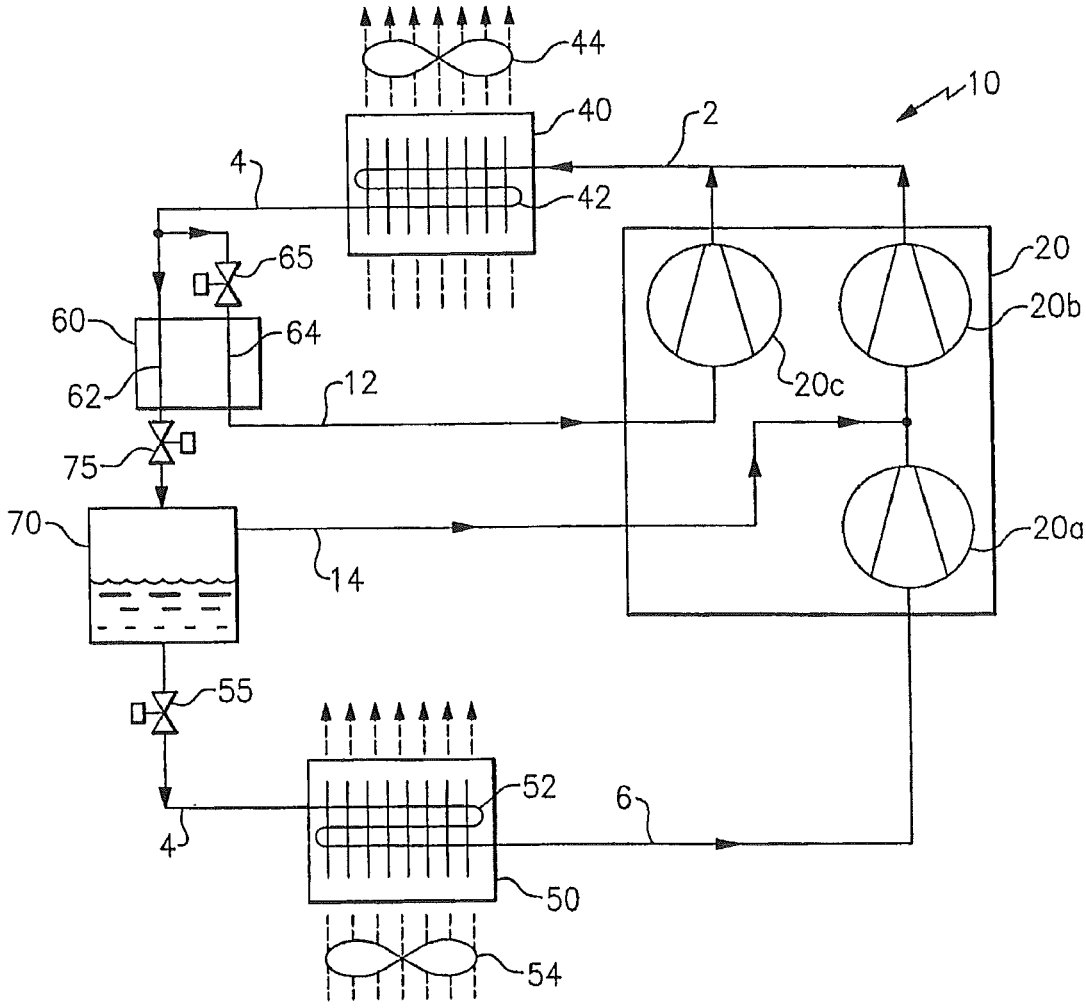
FIG. 1 is a schematic diagram illustrating a first exemplary embodiment of a refrigerant vapor compression system in accord with the invention.

Referring now to FIGS. 1-4, there are depicted therein exemplary embodiments of a refrigerant vapor compression system 10 suitable for use in a transport refrigeration system for refrigerating air supplied to a temperature controlled cargo space of a truck, trailer, container or the like for transporting perishable and frozen goods. The refrigerant vapor compression system 10 is also suitable for use in conditioning air to be supplied to a climate controlled comfort zone within a residence, office building, hospital, school, restaurant or other facility. The refrigerant vapor compression system could also be employed in refrigerating air supplied to display cases, merchandisers, freezer cabinets, cold rooms or other perishable and frozen product storage areas in commercial establishments.

The refrigerant vapor compression system 10 includes a multi-step compression device 20, a refrigerant heat rejecting heat exchanger 40, a refrigerant heat absorbing heat exchanger 50, also referred to herein as an evaporator, and an evaporator expansion valve 55, such as for example an electronic expansion valve or a thermostatic expansion valve, operatively associated with the evaporator 50, with various refrigerant lines 2, 4 and 6 connecting the aforementioned components in a primary refrigerant circuit. In a refrigerant vapor compression system operating in a subcritical cycle, the refrigerant heat rejecting heat exchanger 40 constitutes a refrigerant condensing heat exchanger through which hot, high pressure refrigerant passes in heat exchange relationship with a cooling medium, most commonly ambient air. In a refrigerant vapor compression system operating in a transcritical cycle, the refrigerant heat rejecting heat exchanger 40 constitutes a gas cooler heat exchanger through which supercritical refrigerant passes in heat exchange relationship with a cooling medium, again most commonly ambient air. The refrigerant heat rejecting heat exchanger 40 may also be referred to herein as a condenser/gas cooler. The refrigerant heat rejecting heat exchanger 40 may comprise a finned tube heat exchanger 42 through which hot, high pressure refrigerant passes in heat exchange relationship with a cooling medium, most commonly ambient air drawn through the heat exchanger 42 by the condenser fan(s) 44. The finned tube heat exchanger 42 may comprise, for example, a fin and round tube heat exchange coil or a fin and flat mini-channel tube heat exchanger.

Additionally, the refrigerant vapor compression system 10 of the invention includes a refrigerant-to-refrigerant heat exchanger economizer 60 and a flash tank economizer 70 disposed in series refrigerant flow relationship in refrigerant line 4 of the primary refrigerant circuit downstream with respect to refrigerant flow of the condenser/gas cooler 40 and upstream with respect to refrigerant flow of the evaporator 50. A first economizer circuit refrigerant line 12 connects refrigerant line 4 in refrigerant flow communication with refrigerant line 2 via the refrigerant-to-refrigerant heat exchanger economizer 60. A second economizer circuit refrigerant line 14 connects the flask tank economizer 70 in refrigerant flow communication with an intermediate pressure stage of the compression process. The operation of the respective economizer circuits formed by the refrigerant-to-refrigerant heat exchanger economizer 60 and its associated refrigerant line 12 and by the flash tank economizer 70 and its associated refrigerant line 14 will be discussed hereinafter.

The compression device 20 functions to compress the refrigerant and to circulate refrigerant through the primary refrigerant circuit and the two economizers as will be discussed in further detail hereinafter. In the embodiment depicted in FIG. 1, the compression device 20 includes a single multiple stage refrigerant compressor, for example a scroll compressor, a screw compressor or a reciprocating compressor, disposed in the primary refrigerant circuit and having a first compression stage 20*a*, a second compression stage 20*b* and a third compression stage 20*c*. The first and second compression stages are disposed in series refrigerant flow relationship with the refrigerant leaving the first compression stage passing directly to the second compression stage for further compression. The third compression stage 20*c* is disposed in refrigerant line 12 in parallel refrigerant flow relationship with the second compression stage 20*b*.

Figure 2:
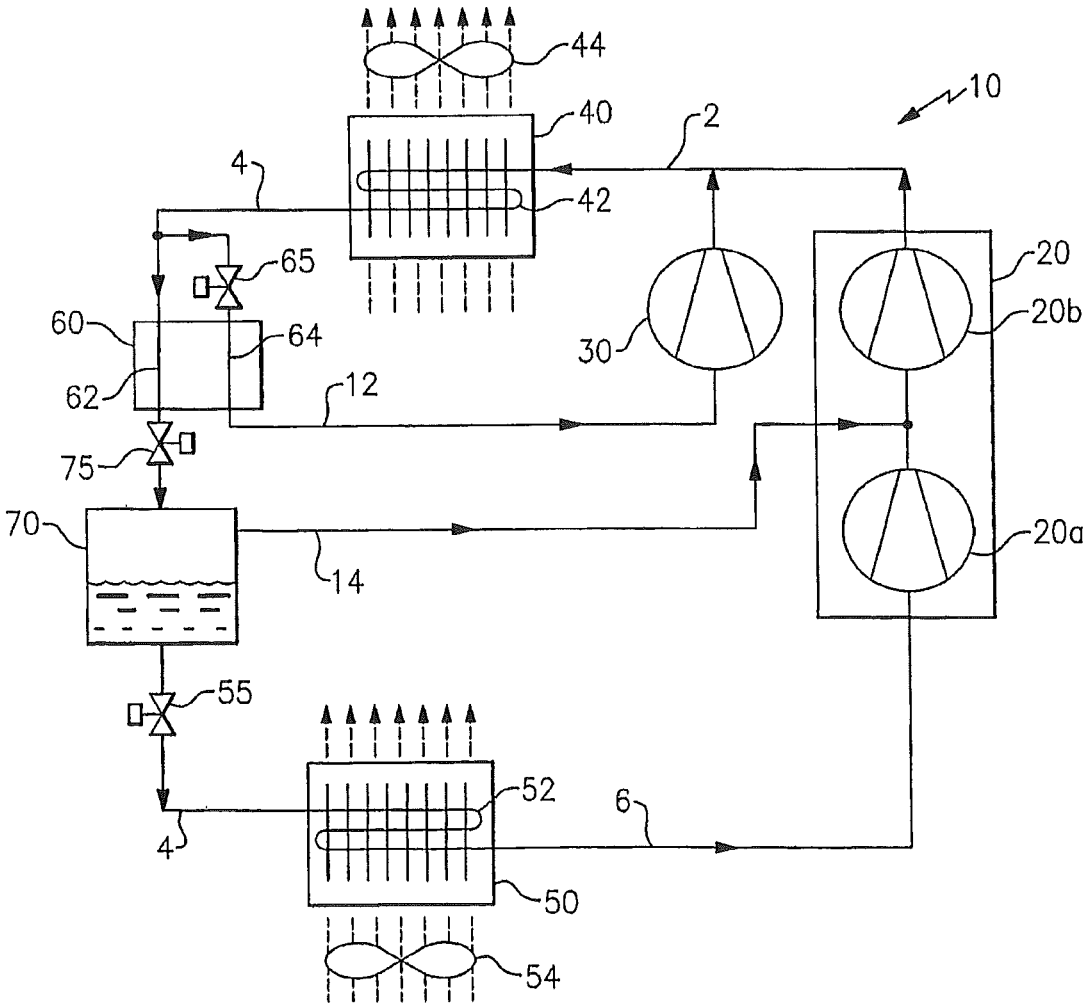
FIG. 2 is a schematic diagram illustrating a second exemplary embodiment of a refrigerant vapor compression system in accord with the invention.

In the embodiment depicted in FIG. 2, the compression device 20 includes a first two-stage compressor, for example a scroll compressor, a screw compressor or a reciprocating compressor, disposed in the primary refrigerant circuit having a first compression stage 20*a* and a second compression stage 20*b*. The first and second compression stages are disposed in series refrigerant flow relationship with the refrigerant leaving the first compression stage passing directly to the second compression stage for further compression. A separate, independent second compressor 30 is disposed in refrigerant line 12 in parallel refrigerant flow relationship with the compression stages 20*a* and 20*b* of the first two-stage compressor 20. The second compressor 30 may be a scroll compressor, a screw compressor, a reciprocating compressor, a rotary compressor or any other type of compressor or a plurality of any such compressors.

Figure 3:
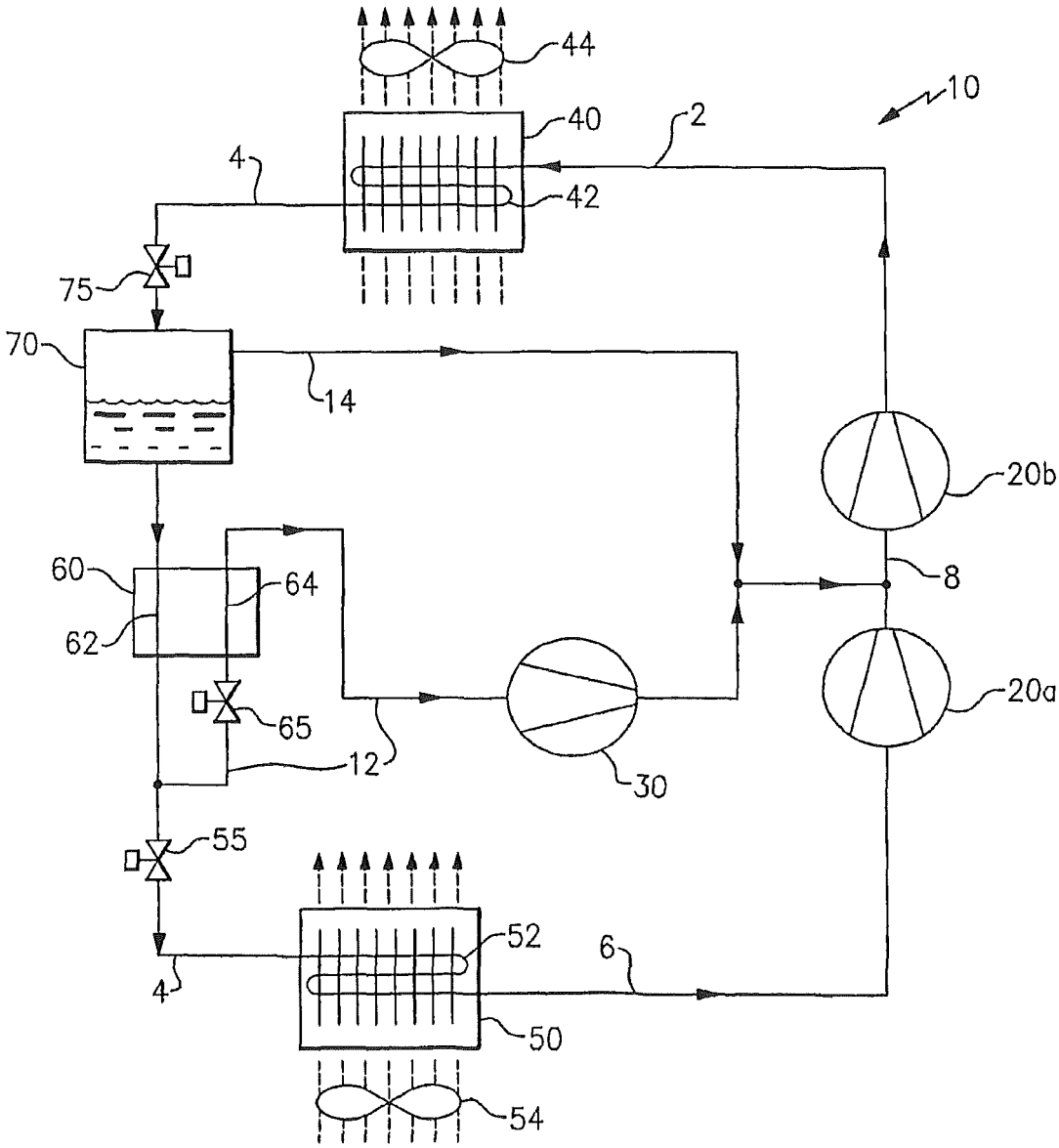
FIG. 3 is a schematic diagram illustrating a third exemplary embodiment of a refrigerant vapor compression system in accord with the invention.
Figure 4:
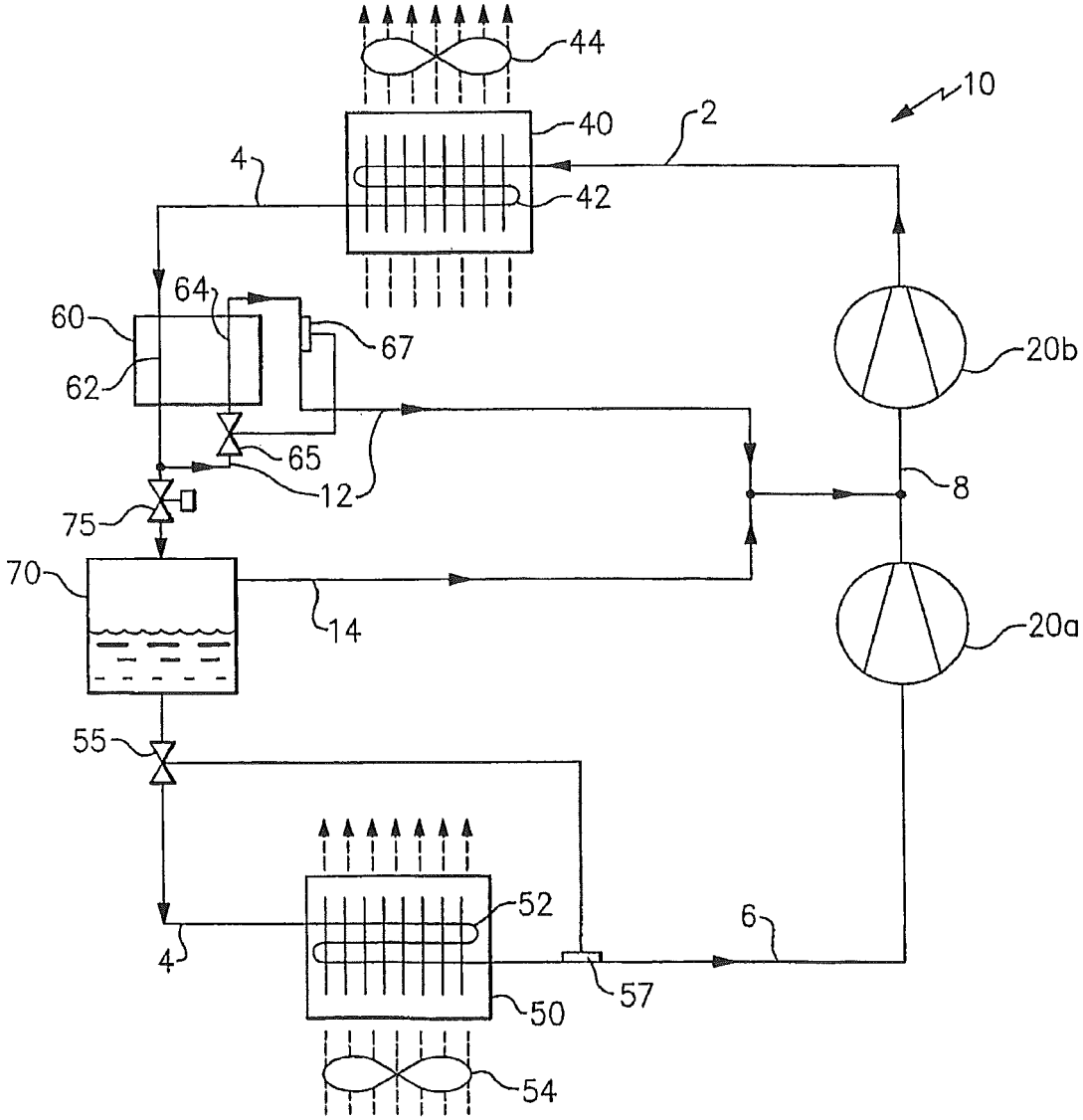
FIG. 4 is a schematic diagram illustrating a fourth exemplary embodiment of a refrigerant vapor compression system in accord with the invention.

In the embodiments depicted in FIGS. 3 and 4, the compression device 20 is a pair of compressors 20A and 20B, connected in series refrigerant flow relationship in the primary refrigerant circuit via a refrigerant line 8 connecting the discharge outlet port of the first compressor 20A in refrigerant flow communication with the suction inlet port of the second compressor 20B. In the embodiment depicted in FIG. 3, a third compressor 30 is disposed in refrigerant line 12 in parallel refrigerant flow relationship with the first compressor 20A. The compressors 20A, 20B and 30 may be scroll compressors, screw compressors, reciprocating compressors, rotary compressors or any other type of compressor or a combination of any such compressors.

As noted hereinbefore, the refrigerant vapor compression system 10 of the invention includes a refrigerant-to-refrigerant heat exchanger economizer 60 disposed in refrigerant line 4 of the primary refrigerant circuit downstream with respect to refrigerant flow of the condenser/gas cooler 40 and upstream with respect to refrigerant flow of the evaporator 50. The refrigerant-to-refrigerant heat exchanger economizer 60 includes a first refrigerant pass 62 and a second refrigerant pass 64 arranged in heat transfer relationship. The first refrigerant pass 62 is interdisposed in refrigerant line 4 and forms part of the primary refrigerant circuit. The second refrigerant pass 64 is interdisposed in and forms part of the first economizer circuit refrigerant line 12. The first economizer circuit refrigerant line 12 may connect to refrigerant line 4 of the primary refrigerant circuit either upstream with respect to refrigerant flow of the first pass 62 of the refrigerant-to-refrigerant heat exchanger as depicted in FIGS. 1 and 2, or downstream with respect to refrigerant flow of the first pass 62 of the refrigerant-to-refrigerant heat exchanger as depicted in FIGS. 3 and 4.

A first economizer expansion valve 65 is disposed in the first economizer circuit refrigerant line 12 upstream with respect to refrigerant flow of the second pass 64 of the refrigerant-to-refrigerant heat exchanger economizer 60. The first economizer expansion valve 65 meters the refrigerant flow that passes through the refrigerant line 12 and the second pass 64 of the refrigerant-to-refrigerant heat exchanger economizer 60 in heat exchange relationship with the refrigerant passing through the first pass of the heat exchanger economizer 60 to maintain a desired level of superheat in the refrigerant vapor leaving the second pass 64 of the heat exchanger economizer 60 to ensure that no liquid is present therein. As noted before, the expansion valve 65 may be a thermostatic expansion valve, for example as depicted in FIG. 4, in which case the expansion valve 65 meters refrigerant flow in response to a signal indicative of the refrigerant temperature or pressure sensed by the sensing device 67, which may be a conventional temperature sensing element, such as a bulb or thermocouple mounted to the refrigerant line 12 downstream of the second pass of the heat exchanger economizer 60. The expansion valve 65 may also be an electronic expansion valve, for example as depicted in FIGS. 1-3, in which case the expansion valve 65 meters refrigerant flow in response to a signal from a controller (not shown) to maintain a desired suction temperature or suction pressure in refrigerant line 12 on the suction side of the compressor 30 (FIGS. 2 and 3) or the compression stage 20*c* of the compression device 20 (FIG. 1).

The refrigerant vapor compression system 10 of the invention also includes a flash tank economizer 70 disposed in refrigerant line 4 of the primary refrigerant circuit downstream with respect to refrigerant flow of the condenser/gas cooler 40 and upstream with respect to refrigerant flow of the evaporator 50 to receive the refrigerant flowing through refrigerant line 4. The refrigerant-to-refrigerant heat exchanger economizer 60 and the flask tank economizer 70 are disposed in refrigerant line 4 of the primary refrigerant circuit in series refrigerant flow relationship. The flash tank economizer 70 may be disposed downstream with respect to refrigerant flow of the refrigerant-to-refrigerant heat exchanger economizer 60 such as depicted in the exemplary embodiments in FIGS. 1, 2 and 4. Alternatively, the flash tank economizer 70 may be disposed upstream with respect to refrigerant flow of the refrigerant-to-refrigerant heat exchanger 60 such as depicted in the exemplary embodiment in FIG. 3.

In either case, a secondary expansion device 75 is disposed in refrigerant line 4 of the primary refrigerant circuit upstream with respect to refrigerant flow of the inlet to the flash tank to expand the refrigerant passing through refrigerant line 4 to a lower pressure and a lower temperature before the refrigerant passes into the flash tank economizer 70. The secondary expansion device 75 may be an electronic expansion valve or simply a fixed orifice expansion device. Whether the system 10 is operating in a subcritical or a transcritical cycle, within the flash tank economizer 70, the expanded refrigerant separates into a liquid refrigerant portion that collects in the lower portion of the flash tank economizer 70 and into a vapor portion that collects in the upper portion of the flash tank economizer 70 above the liquid level within the flash tank economizer 70.

Vapor refrigerant collecting in the portion of the flash tank economizer 70 above the liquid level therein passes from the flask tank economizer 70 through the second economizer refrigerant line 14 to return to the compression device 20 at an intermediate pressure stage of the compression process. If, as in the embodiments depicted in FIGS. 1 and 2, the compression device 20 is a single, multi-stage compressor, the second economizer circuit refrigerant line 14 communicates an intermediate pressure stage of the compression process. For example, if the compression device 20 is a multi-stage reciprocating compressor, refrigerant line 14 injects refrigerant directly into an intermediate pressure stage of the reciprocating compressor. If the compression device 20 is a single scroll compressor or a single screw compressor, the refrigerant line 14 injects refrigerant into an injection port of the compression device 20 opening to the compression chamber of the compression device 20 at an intermediate pressure between the first compression stage 20*a* and the second compression stage 20*b*. If, as in the embodiments depicted in FIGS. 3 and 4, the compression device 20 is a pair of compressors 20A, 20B, for example a pair of scroll compressors, or screw compressors, or reciprocating compressors, connected in series, or a single reciprocating compressor having a first bank and a second bank of cylinders, the second economizer circuit refrigerant line 14 communicates with refrigerant line 8 that connects the discharge outlet port of the first compressor 20A in refrigerant flow communication with the suction inlet port of the second compressor 20B.

Liquid refrigerant collecting in the lower portion of the flash tank economizer 70 passes therefrom through refrigerant line 4 and traverses the primary refrigerant circuit expansion valve 55, which may be an electronic expansion valve or a conventional thermostatic expansion valve, disposed in refrigerant line 4 upstream with respect to refrigerant flow of the evaporator 50. As this liquid refrigerant traverses the first expansion device 55, it expands to a lower pressure and temperature before entering enters the evaporator 50. The evaporator 50 constitutes a refrigerant evaporating heat exchanger, such as a conventional finned tube heat exchanger 52, such as for example a fin and round tube heat exchange coil or a fin and mini-channel flat tube heat exchanger, through which expanded refrigerant passes in heat exchange relationship with a heating fluid, whereby the refrigerant is vaporized and typically superheated. The heating fluid passed in heat exchange relationship with the refrigerant in the evaporator 50 may be air passed over the finned tube heat exchanger 52 by an associated fan(s) 54 to be cooled, and generally also dehumidified, and thence supplied to a climate controlled environment such as a perishable/frozen cargo storage zone associated with a transport refrigeration unit, or a food display or storage area of a commercial establishment, or a building comfort zone associated with an air conditioning system. The low pressure refrigerant vapor leaving the evaporator 50 returns through refrigerant line 6 to the suction port of the first stage 20*a* of the compression device 20 in the embodiments depicted in FIGS. 1 and 2, or to the compressor 20A in the embodiments depicted in FIGS. 3 and 4.

As in conventional practice, the evaporator expansion valve 55 meters the refrigerant flow through the refrigerant line 6 to maintain a desired level of superheat in the refrigerant vapor leaving the evaporator 50 to ensure that no liquid is present in the refrigerant leaving the evaporator. As noted before, the evaporator expansion valve 55 may be a thermostatic expansion valve, for example as depicted in FIG. 4, in which case the expansion valve 55 meters refrigerant flow in response to a signal indicative of the refrigerant temperature or pressure sensed by the sensing device 57, which may be a conventional temperature sensing element, such as a bulb or thermocouple mounted to the refrigerant line 6 in the vicinity of the evaporator outlet. The evaporator expansion valve 55 may also be an electronic expansion valve, in which case the expansion valve 55 meters refrigerant flow in response to a signal from a controller (not shown) to maintain a desired suction temperature or suction pressure in refrigerant line 6 on the suction side of the compression device 20.

The operation of the refrigerant vapor compression system 10 of the invention will be described with respect to operation in a transcritical mode, that is with a refrigerant, such as for example carbon dioxide, that is in a supercritical state on the high pressure side of the system and in a subcritical state on the low pressure side of the system. The operation of the system 10 will first be described with respect to the embodiments wherein the refrigerant-to-refrigerant heat exchanger economizer 60 is disposed upstream with respect to refrigerant flow of the flash tank heat exchanger 70. Referring now to FIGS. 1, 2 and 4, refrigerant discharges from the compression device 20 as a high pressure, high temperature vapor and passes through refrigerant line 2 to and through the heat exchanger 42 of the gas cooler 40. As the refrigerant vapor traverses the heat exchanger 42, the refrigerant vapor is cooled as it passes in heat exchange relationship with a cooling medium, most typically ambient air drawn over the heat exchanger 42 via the fan(s) 44. The cooled refrigerant vapor leaving the heat exchanger 42 thence passes through refrigerant line 4 and through the first pass 62 of the refrigerant-to-refrigerant heat exchanger 60 and thence through the secondary expansion device 75 prior to entering the flash tank economizer 70.

A portion of the cooled refrigerant vapor passing through refrigerant line 4 is diverted into the first economizer circuit refrigerant line 12 from the refrigerant line 4 either at a point upstream with respect to refrigerant flow of the first pass 62 of the heat exchanger economizer 60, such as depicted in FIGS. 1 and 2, or at a point downstream of the first pass 62 of the heat exchanger economizer 60 and upstream of the secondary expansion device 75, such as depicted in FIG. 4. The refrigerant passing through refrigerant line 12 first traverses the first economizer expansion valve 65 wherein the refrigerant is expanded to a lower pressure and lower temperature vapor. The expanded refrigerant vapor thence passes through the second pass 64 of the heat exchanger economizer 60 in heat exchange relationship with the refrigerant vapor passing through the first pass 62 of the heat exchanger economizer 60 to further cool that refrigerant vapor. Having passed through the second pass 64 of the heat exchanger economizer 60, this diverted portion of the refrigerant continues on through refrigerant line 12 to be reintroduced into the primary refrigerant circuit.

In the embodiments depicted in FIGS. 1 and 2, this diverted portion is recompressed, via either the third compression stage 20*c* of the compression device 20 or a separate compressor 30, to the system's high side pressure and reintroduced into refrigerant line 2 upstream of the gas cooler 40. In the embodiment depicted in FIG. 1, the refrigerant passing through the first economizer circuit refrigerant line 12 passes through the third compression stage 20*c* of the compression device 20 which operates in parallel with the compression stages 20*a* and 20*b* of the compression device 20. In the embodiment depicted in FIG. 2, the refrigerant passing through the first economizer circuit refrigerant line 12 passes through the secondary compressor 30 which operates in parallel with the primary compression device 20.

In the embodiment depicted in FIG. 4, the refrigerant diverted through refrigerant line 12 is reintroduced into the primary refrigerant circuit at an intermediate pressure stage of the compression process, that is at a pressure intermediate the system low side pressure, also referred to as the suction pressure, and the system high side pressure, also referred to as the discharge pressure. If the refrigerant passing through the first economizer expansion valve 65 has been expanded to a pressure somewhat above the intermediate injection pressure, the refrigerant passing through refrigerant line 12 may be injected directly into the intermediate compression stage of the compression device 20 without any further compression, such as depicted in FIG. 4. However, if the refrigerant passing through the first economizer expansion valve 65 has been expanded to a pressure lower than the intermediate injection pressure, an auxiliary compressor 30 may be disposed in the refrigerant line 12 to compress the refrigerant to desired intermediate pressure, such as depicted in FIG. 3.

The refrigerant having traversed the first pass 62 of the refrigerant-to-refrigerant heat exchanger 60 is expanded as it traverses the secondary expansion device 75 to a lower pressure and lower temperature liquid and vapor mix prior to entering the flash tank economizer 70. Within the flash tank economizer 70, the refrigerant mixture separates into a liquid refrigerant that collects in a lower portion of the flash tank economizer 70 and a refrigerant vapor that collects in an upper portion of the flash tank economizer 70 above the liquid level within the flash tank economizer 70. Vapor refrigerant collecting in the portion of the flash tank economizer 70 above the liquid level therein passes from the flask tank economizer 70 through the refrigerant line 14 to return to the compression device 20 at an intermediate pressure stage of the compression process. Liquid refrigerant collecting in the lower portion of the flash tank economizer 70 passes therefrom through refrigerant line 4 and traverses the primary refrigerant circuit expansion valve 55 prior to passing through the evaporator 50. The refrigerant vapor leaving the evaporator 50 passes through refrigerant line 6 to the suction inlet of the compression device 20, that is either to the suction inlet of the first compression stage 20*a* or to the suction inlet of the first compressor 20A.

In the exemplary embodiment of the refrigerant vapor compression system 10 depicted in FIG. 3, the vapor tank economizer 70 is disposed upstream with respect to refrigerant flow of the refrigerant-to-refrigerant heat exchanger economizer 60 rather than downstream as in the exemplary embodiments depicted in FIGS. 1, 2 and 4. Referring now to FIG. 3, refrigerant discharges from the compression device 20 as a high pressure, high temperature vapor and passes through refrigerant line 2 to and through the heat exchanger 42 of the gas cooler 40. As the refrigerant vapor traverses the heat exchanger 42, the refrigerant vapor is cooled as it passes in heat exchange relationship with a cooling medium, most typically ambient air drawn over the heat exchanger 42 via the fan(s) 44. The cooled refrigerant vapor leaving the heat exchanger 42 thence passes through refrigerant line 4 and the economizer expansion valve 75 prior to entering the flash tank economizer 70. The refrigerant is expanded as it traverses the secondary expansion device 75 to a lower pressure and lower temperature liquid and vapor mix prior to entering the flash tank economizer 70.

Within the flash tank economizer 70, the refrigerant mixture separates into a liquid refrigerant that collects in a lower portion of the flash tank economizer 70 and a refrigerant vapor that collects in an upper portion of the flash tank economizer 70 above the liquid level within the flash tank economizer 70. Vapor refrigerant collecting in the portion of the flash tank economizer 70 above the liquid level therein passes from the flask tank economizer 70 through the refrigerant line 14 to return to the compression device 20 at an intermediate pressure stage of the compression process. Liquid refrigerant collecting in the lower portion of the flash tank economizer 70 passes therefrom through refrigerant line 4, passing through the first pass 62 of the refrigerant-to-refrigerant heat exchanger 60 and thence traversing the primary refrigerant circuit expansion valve 55 prior to passing through the evaporator 50. The refrigerant vapor leaving the evaporator 50 passes through refrigerant line 6 to the suction inlet of the compression device 20, that is either to the suction inlet of the first compression stage 20*a* or to the suction inlet of the first compressor 20A.

A portion of the cooled refrigerant vapor passing through refrigerant line 4 is diverted into the first economizer circuit refrigerant line 12 from the refrigerant line 4 at a downstream of the flash tank economizer 70 and either upstream with respect to refrigerant flow of the first pass 62 of the heat exchanger economizer 60 or at a point downstream of the first pass 62 of the heat exchanger economizer 60 and upstream of the primary expansion valve 55. The refrigerant passing through refrigerant line 12 first traverses the first economizer expansion valve 65 wherein the refrigerant is expanded to a lower pressure and lower temperature vapor. The expanded refrigerant vapor thence passes through the second pass 64 of the heat exchanger economizer 60 in heat exchange relationship with the refrigerant vapor passing through the first pass 62 of the heat exchanger economizer 60 to further cool that refrigerant vapor. Having passed through the second pass 64 of the heat exchanger economizer 60, this diverted portion of the refrigerant continues on through refrigerant line 12 to be reintroduced into the primary refrigerant circuit. In the embodiment depicted in FIG. 3, the refrigerant diverted through refrigerant line 12 is introduced into the suction inlet of the compressor 30 and recompressed to a desired intermediate pressure stage of the compression process, that is at a pressure intermediate the system low side pressure, also referred to as the suction pressure, and the system high side pressure, also referred to as the discharge pressure.

The primary expansion valve 55 associated with the evaporator 50 and the secondary expansion device 75 associated with the flash tank economizer 70 in combination provide a two-step expansion process for expanding the refrigerant passing through refrigerant line 4 from the condenser/gas cooler 40 to the evaporator 50. The refrigerant vapor compression system of the invention integrates a two-step expansion process with dual economizer circuits to provide a system having improved efficiency and capacity compared to prior art systems having a single step expansion process and either a refrigerant-to-refrigerant heat exchanger economizer or a flash tank economizer.

Figure 5:
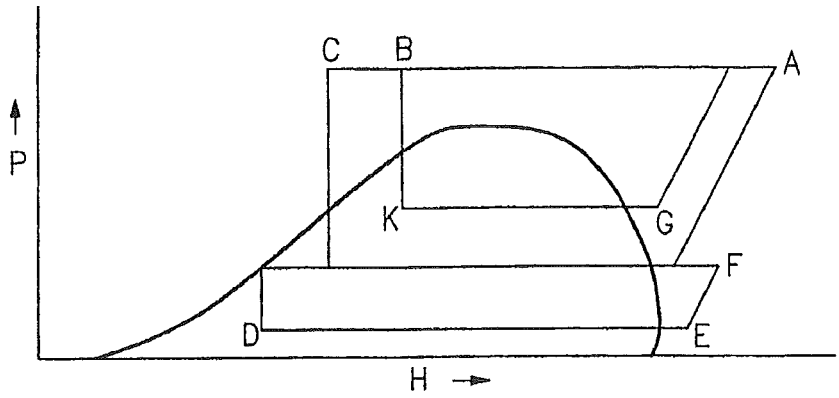
FIG. 5 is a graph illustrating the pressure to enthalpy relationship for the exemplary embodiment of the refrigerant vapor compression system of the invention illustrated in FIG. 1 operating in a transcritical cycle.
Figure 6:
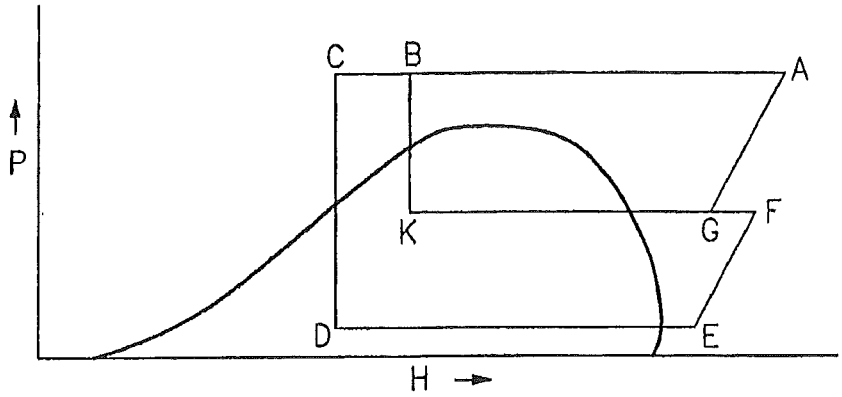
FIG.6 Prior Art
FIG. 6 is a graph illustrating the pressure to enthalpy relationship for a prior art refrigerant vapor compression system operating in a transcritical cycle with a single refrigerant-to-refrigerant heat exchanger economizer.
Figure 7:
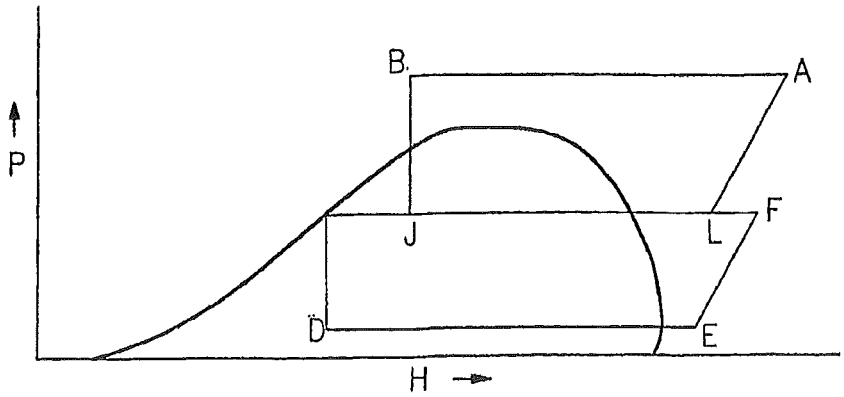
FIG.7 Prior Art
FIG. 7 is a graph illustrating the pressure to enthalpy relationship for a prior art refrigerant vapor compression system operating in a transcritical cycle with a single flash tank economizer.

A comparison of the pressure to enthalpy relationship presented in FIG. 5, which represents a characteristic pressure to enthalpy relationship for the refrigerant vapor compression system 10 of FIG. 1, to either of the pressure to enthalpy relationships representative of conventional refrigerant vapor compression systems presented in FIG. 6 or FIG. 7, illustrates the capacity improvement associated with the refrigerant vapor compression system of the invention. FIG. 6 presents a characteristic pressure to enthalpy relationship for a conventional prior art refrigerant vapor compression having a single refrigerant-to-refrigerant heat exchanger economizer. FIG. 7 presents a characteristic pressure to enthalpy relationship for a conventional prior art refrigerant vapor compression having a single flash tank economizer. In each of FIGS. 5-7, AB represents the gas heat rejection process within gas cooler 40, KG represents the process within the refrigerant-to-refrigerant heat exchanger economizer circuit, JK represents the process within the flash tank economizer circuit, and DE represents the gas heat absorption process within the evaporator 50. The evaporator line DE in FIG. 1 is longer than the respective evaporator lines associated with either of the prior art single economizer systems, indicating the capacity improvement associated with the two-step expansion, dual economizer refrigerant vapor compression system of the invention.

Those skilled in the art will recognize that many variations may be made to the particular exemplary embodiments described herein. For example, each of the depicted embodiments may be modified by switching the upstream/downstream relationship between the respective refrigerant-to-refrigerant heat exchanger economizer and flash tank economizer or by substituting a pair of compressors for a single two-stage compressor or vise versa. The refrigerant-to-refrigerant heat exchanger employed may be a brazed plate heat exchanger, a tube-in-tube heat exchanger or a shell and tube heat exchanger, or any other type of heat exchanger providing efficient refrigerant to refrigerant heat exchange.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. A refrigerant vapor compression system comprising:

a refrigerant circuit including a refrigerant compression device, a refrigerant cooling heat exchanger for passing refrigerant received from said compression device at a high pressure in heat exchange relationship with a cooling medium, a refrigerant heating heat exchanger for passing refrigerant at a low pressure refrigerant in heat exchange relationship with a heating medium, and a primary expansion device disposed in the refrigerant circuit downstream of said refrigerant cooling heat exchanger and upstream of said refrigerant heating heat exchanger;

a first economizer circuit including a refrigerant-to-refrigerant heat exchanger economizer having a first refrigerant pass disposed in the refrigerant circuit downstream of said refrigerant cooling heat exchanger and upstream of said primary expansion device;

a second economizer circuit including a flash tank economizer disposed in the refrigerant circuit downstream of said refrigerant cooling heat exchanger and upstream of said primary expansion device, said flash tank economizer and said refrigerant-to-refrigerant economizer disposed in said refrigerant circuit in a series refrigerant flow relationship; and a secondary expansion device disposed in the refrigerant circuit in operative association with and upstream with of said flash tank economizer.

2. A refrigerant vapor compression system as recited in claim 1 wherein said flash tank economizer is disposed in said refrigerant circuit downstream with respect to refrigerant flow of the first refrigerant pass of said refrigerant-to-refrigerant heat exchanger.

3. A refrigerant vapor compression system as recited in claim 1 wherein said flash tank economizer is disposed in said refrigerant circuit upstream with respect to refrigerant flow of the first refrigerant pass of said refrigerant-to-refrigerant heat exchanger.

4. A refrigerant vapor compression system as recited in claim 1 wherein said refrigerant-to-refrigerant heat exchanger economizer includes a first refrigerant pass and a second refrigerant pass disposed in heat exchange relationship, said first refrigerant pass in refrigerant flow communication with said refrigerant circuit and said second refrigerant pass in refrigerant flow communication with said first economizer circuit.

5. A refrigerant vapor compression system as recited in claim 4 wherein said first economizer circuit further comprises: a first economizer circuit refrigerant line passing from said refrigerant circuit through the second refrigerant pass of said refrigerant-to-refrigerant heat exchanger economizer and reconnecting to said refrigerant circuit, and an economizer circuit expansion device interdisposed in said first economizer circuit refrigerant line upstream of the second refrigerant pass of said refrigerant-to-refrigerant heat exchanger.

6. A refrigerant vapor compression system as recited in claim 5 further comprising an economizer compressor operatively associated with said first economizer circuit for recompressing refrigerant vapor passing through said first economizer circuit refrigerant line.

7. A refrigerant vapor compression system as recited in claim 6 wherein said economizer compressor comprises an independent compressor.

8. A refrigerant vapor compression system as recited in claim 6 wherein said compression device comprises a single compressor having at least three compression stages and said economizer circuit compressor comprises one of said compression stages of said compression device.

9. A refrigerant vapor compression system as recited in claim 1 wherein said second economizer circuit further comprises a second economizer circuit refrigerant line establishing refrigerant vapor flow communication between said flash tank economizer and an intermediate pressure stage of said compression device.

10. A refrigerant vapor compression system as recited in claim 1 wherein: said first economizer circuit further comprises a first economizer circuit refrigerant line passing from said refrigerant circuit through the second refrigerant pass of said refrigerant-to-refrigerant heat exchanger economizer and reconnecting to said refrigerant circuit at an intermediate compression stage of said compression device; and said second economizer circuit further comprises a second economizer circuit refrigerant line establishing refrigerant vapor flow communication between said flash tank economizer and an intermediate pressure stage of said compression device.

11. A refrigerant vapor compression system as recited in claim 1 wherein said compression device comprises a single compressor having at least two compression stages.

12. A refrigerant vapor compression system as recited in claim 1 wherein said compression device comprises at least two compressors disposed in the refrigerant circuit in a series relationship with respect to refrigerant flow.

13. A refrigerant vapor compression system as recited in claim 1 wherein said system operates in a subcritical cycle.

14. A refrigerant vapor compression system as recited in claim 1 wherein said system operates in a transcritical cycle.

15. A refrigerant vapor compression system as recited in claim 1 wherein the refrigerant comprises carbon dioxide.

16. A refrigerant vapor compression system as recited in claim 1 wherein said primary expansion device comprises an electronic expansion valve.

17. A refrigerant vapor compression system as recited in claim 1 wherein said primary expansion device comprises a thermostatic expansion valve.

18. A refrigerant vapor compression system as recited in claim 1 wherein said secondary expansion device comprises an electronic expansion valve.

19. A refrigerant vapor compression system as recited in claim 1 wherein said secondary expansion device comprises a fixed orifice expansion device.

20. A refrigerant vapor compression system as recited in claim 5 wherein said economizer circuit expansion device comprises an electronic expansion valve.

21. A refrigerant vapor compression system as recited in claim 5 wherein said economizer circuit expansion device comprises a thermostatic expansion valve.

22. A refrigerant vapor compression system as recited in claim 1 wherein said compression device comprises a scroll compressor.

23. A refrigerant vapor compression system as recited in claim 1 wherein said compression device comprises a reciprocating compressor.

24. A refrigerant vapor compression system as recited in claim 1 wherein said compression device comprises a screw compressor.

25. A refrigerant vapor compression system as recited in claim 1 wherein said system is incorporated in a transport refrigeration system for conditioning a temperature controlled cargo storage region.

26. A refrigerant vapor compression system as recited in claim 23 wherein said system operates in a transcritical cycle.

27. A refrigerant vapor compression system as recited in claim 24 wherein the refrigerant comprises carbon dioxide.

* * * * *